US005284005A

United States Patent [19]

Jacobi

[11] Patent Number: 5,284,005

[45] Date of Patent: Feb. 8, 1994

[54] A CHILD'S OR HANDICAPPED PERSON'S SADDLE RESTRAINT DEVICE

[76] Inventor: Lisa Jacobi, Rte. 5, Box 5039, Buhl, Id. 83316

[21] Appl. No.: 11,465

[22] Filed: Jan. 27, 1993

[51] Int. Cl.[5] ..... B68C 1/18

[52] U.S. Cl. ..... 54/44.2; 54/44.5

[58] Field of Search ..... 54/44.1, 44.2, 44.5; 119/96; 297/250, 464, 465, 467, 468, 485, 487, 488, 275; 434/247; 482/69, 904, 143, 144

[56] References Cited

U.S. PATENT DOCUMENTS

| | | | |
|---|---|---|---|
| 721,653 | 3/1903 | Amos | 54/44.5 |
| 950,678 | 3/1910 | Reisacher | 54/44.5 |
| 1,214,364 | 1/1917 | Peterson . | |
| 1,397,128 | 11/1921 | Keithley | 54/44.5 |
| 2,767,408 | 10/1956 | Keibman | 297/250 |
| 3,234,710 | 2/1966 | Gauthier | 54/44 |
| 3,266,218 | 8/1966 | Pentz | 54/44 |
| 3,765,375 | 10/1973 | Young | 119/96 |
| 3,916,604 | 11/1975 | Phipps | 54/44 |
| 4,872,725 | 10/1989 | Hakeem | 297/488 |
| 5,029,434 | 7/1991 | Erickson | 54/46 |
| 5,137,335 | 4/1992 | Marten | 297/488 |
| 5,148,563 | 9/1992 | Kearman et al. | 297/467 |

FOREIGN PATENT DOCUMENTS

| | | | |
|---|---|---|---|
| 3205844 | 8/1983 | Fed. Rep. of Germany | 54/44.1 |
| 2552065 | 3/1985 | France | 54/44.1 |

*Primary Examiner*—John J. Wilson
*Assistant Examiner*—Todd E. Manahan
*Attorney, Agent, or Firm*—Hopkins, French, Crockett, Springer & Hoopes

[57] ABSTRACT

A releasable restraining device suitable for use with saddle-type seats for horses, motor vehicles, or other forms of locomotion. The releasable restraining device includes a toroidal, semicircular, or elliptical doughnut-shaped rubber bladder or other suitable material for circumventing the rider and attachments for securing the rider's lower extremities to the saddle, thereby allowing his upper torso to be free to manipulate the vehicle or the reins of a horse.

2 Claims, 2 Drawing Sheets

A CHILD'S OR HANDICAPPED PERSON'S SADDLE RESTRAINT DEVICE

BACKGROUND OF THE INVENTION

1. Field of the Invention

The field of the invention relates to a saddle rider restraining device and, more particularly, to a torus or doughnut-shaped restraining means for enveloping the rider and attachment to a saddle so as to secure an individual rider to the saddle to enhance balanced riding within the saddle during movement of the underlying mode of locomotion, for instance, a horse.

2. Description of the Prior Art

It has long been understood by those skilled in the art that a child or handicapped person needs assistance in riding a horse or other form of locomotion where a saddle is used to maintain the individual in a seated position. U.S. Pat. No. 1,214,364 issued to Peterson on Jan. 30, 1917, teaches a child's saddle that is strapped to the horse's neck as well as secured to the adult saddle behind. U.S. Pat. No. 3,266,218 issued to Pentz on Aug. 16, 1966; U.S. Pat. No. 3,916,604 issued to Phipps on Nov. 4, 1975; and U.S. Pat. No. 3,234,710 issued to Gauthier on Feb. 15, 1966, all teach children's saddles that are attached to existing adult saddles. U.S. Pat. No. 5,029,434 issued to Erickson on Jul. 9, 1991, teaches a harness designed to secure handicapped people to a saddle. These solutions of the prior art provide either a child-sized saddle to more comfortably fit the child or a fully-restraining harness kit so as to make it impossible for the occupant to remove himself from the saddle without assistance. Accordingly, it would be desirable to have a rider restraint for fully enveloping and securing the rider to the saddle while allowing the rider's upper torso free to simulate unrestrained riding.

Prior art child and handicapped saddle seating enhancements do not address an emergency function, i.e., how to release the restrained rider from the saddle when desired or necessitated by emergency. This is unfortunate, because any apparatus that restrains or prevents disengagement of the rider from the saddle during normal riding or operation becomes dangerous in times of emergency when it is necessary to remove the rider from the saddle. Accordingly, it would be desirable to have a releasable saddle restraining means to enhance saddle seating during all foreseen and unforeseen riding circumstances.

SUMMARY OF THE INVENTION

Briefly, the present invention encompasses a toroidal or doughnut-shaped releasable restraining means for completely encircling a rider's lower body and attachment to the saddled vehicle or animal. The toroidal, doughnut-shape appliance may take the form of a fixed structural reinforcement, such as, for instance, Styrofoam TM, cloth, or any other flexible or inflexible material, or may take the form of an inflatable or non-inflatable elastic material, such as, an inflatable inner tube. The releasable function of the restraining means may be accomplished by the use of a releasable attachment means to the saddle or a releasable separation means built into the toroidal or doughnut-shaped structure.

When the releasable restraining means of the invention is utilized in conjunction with a saddle for a horse, the invention can include a triangular-shaped padded pillow for filling unutilized space in the front portion of the saddle as well as covering up the saddle horn and rise, respectively. The fixed surface toroidal appliance or doughnut-shaped appliance may include annular cutouts for overlay of the legs of the rider. While the flexible surface embodiment may also employ these annular cutouts, the flexible nature of the medium allows the medium to conform to the leg of the rider and forms its own receptacle for the rider's legs.

Other objects, advantages, and capabilities of the present invention will become more apparent as the description proceeds.

BRIEF DESCRIPTION OF THE DRAWINGS

The invention may be better understood and further advantages and uses thereof may become more readily apparent when considered in view of the following detailed description of the exemplary embodiments, taken with the accompanied drawings, in which.

DETAILED DESCRIPTION OF THE PREFERRED EMBODIMENTS

Figure 1:
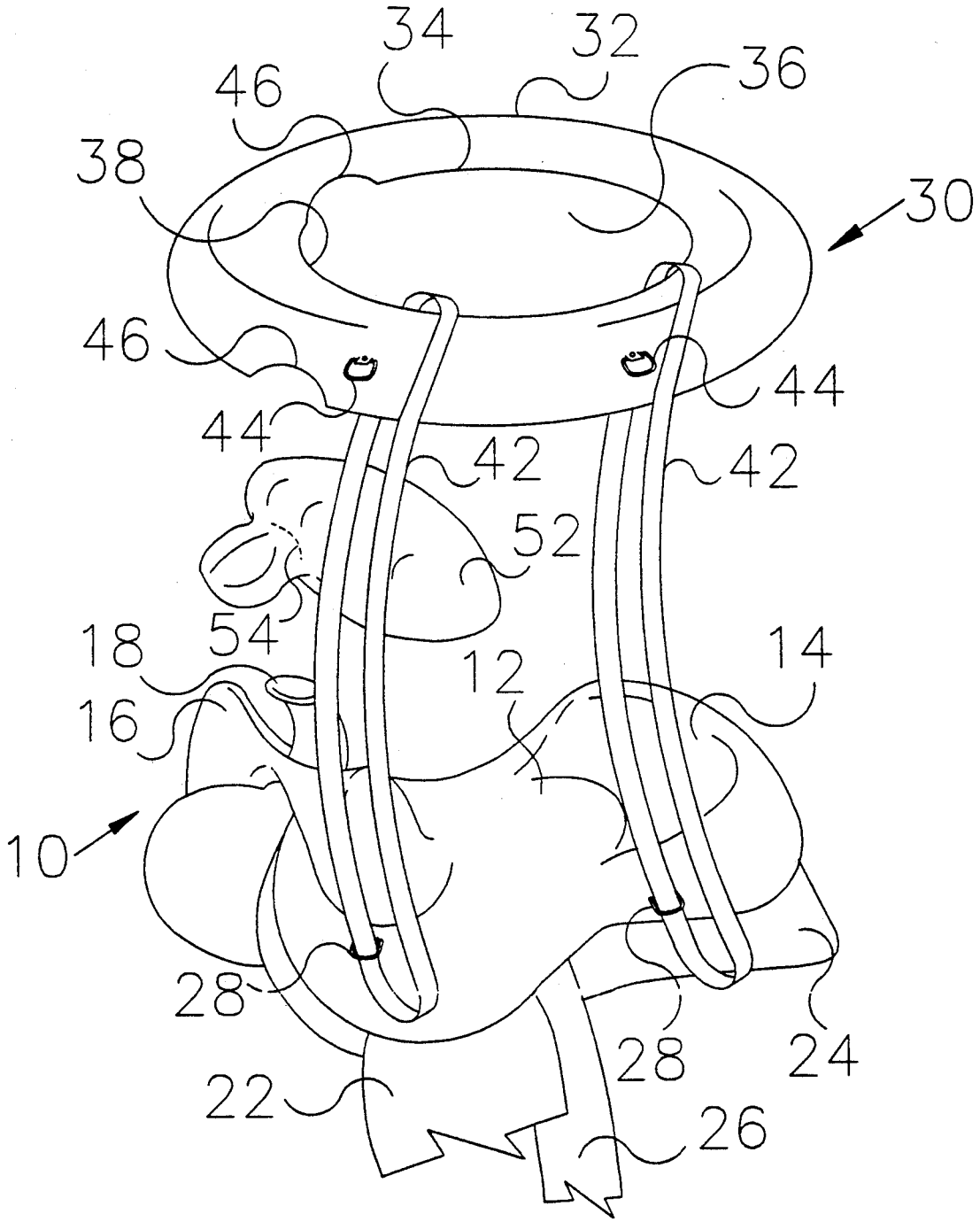
FIG. 1 is a perspective view of a standard-sized saddle, such as would be used for horseback riding, and a toroidal, doughnut-shaped rider restraining means, and a triangular spacer means that may be utilized in conjunction with the doughnut-shaped rider restraining means, all constructed according to the teachings of the invention.

Referring now to the drawings and, in particular, to FIG. 1, there is shown a full-sized saddle 10 of the Western type, depicted in all its glory. Saddle 10 is formed by seat 12 terminating at the rear by cantle 14 and at the front by pommel 16 and horn 18. Stirrup assemblies 22 and adjacent skirt 24 generally extend downwardly from beneath seat 12. Cinch straps 26 extend downwardly from the saddle for attachment about the horse (not shown). Multiple accessory rings 28 are generally located about stirrup assemblies 22 and skirt 24.

Toroidal, doughnut-shaped restraining means 30 is shown directly above saddle 10 and is most useful for keeping a young or handicapped rider restrained in saddle 10 while allowing full movement of the upper body. Doughnut-shaped restraining means 30 may be in the form of a circular or elliptical toroid having outer periphery 32 and inner periphery 34 defining an interior space or a hole, shown generally at 36. Doughnut-shaped restraining means 30 may be operated by placing inner cutout hole 36 over the top of a seated rider, hooking the front portion 38 of inner periphery 34 over saddle horn 18 and then attaching doughnut-shaped restraining means 30 to saddle 10 or the underlying horse or vehicle by means of straps 42. Straps 42 are laced through "D" rings 28 and circumvent doughnut-shaped restraining means 30. Alternately, straps 42 may be threaded through attachment "D" rings 44, which may be attached directly to doughnut-shaped restraining means 30 or an outside covering, which encapsulates doughnut-shaped, toroid restraining means 30. Still, alternately, straps 42 may be attached to other saddle or harness appliances or may circumvent the horse or underlying vehicle itself. Toroidal, doughnut-shaped restraining means 30 may be made of any suitable, light-weight material, such as Styrofoam TM, plastic, rubber, etc. A rubber or vinyl bladder known in the art as an inner tube with or without fabric covering has worked very well. Doughnut-shaped restraining means 30 may include annular cutouts 46 for overlay of the legs of the rider, especially if made of a rigid material. While the flexible embodiment may also employ these annular cutouts, the flexible nature of the material allows the material to self-conform to the legs of the rider.

For very small riders, triangular pillow 52 may be used in conjunction with doughnut-shaped restraining means 30. Triangular pillow 52 incorporates a pocket disposed on the underside thereof and is shown by phantom line 54 in FIG. 1. Pocket 54 is suitable for slipping over saddle horn 18 prior to circumventing saddle horn 18 with doughnut-shaped restraining means 30. Triangular pillow 52 is utilized to take up the empty space in the front of a small child on saddle 10 and may be made of any suitable soft material, such as rubber, plastic, cloth, etc.

Figure 2:
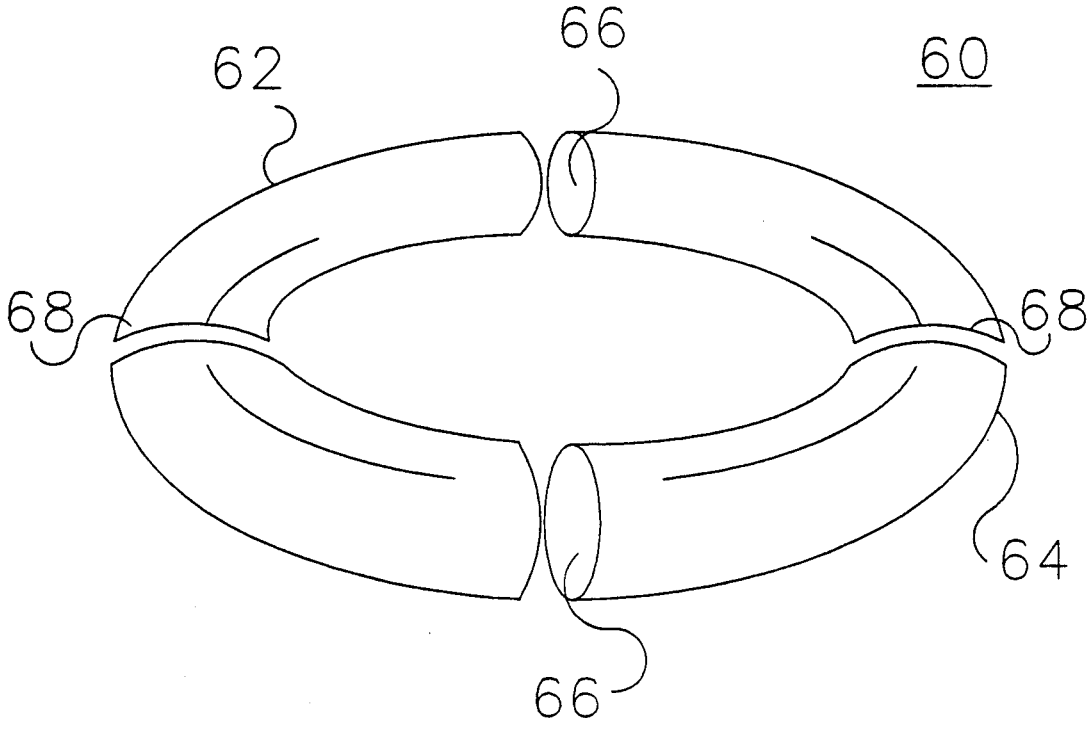
FIG. 2 is an isometric illustration of a releasable toroidal, doughnut-shaped releasable rider restraint, constructed according to the teachings of the invention.

In an emergency, it may be desirable to remove or free the rider from the saddle and from within doughnut-shaped restraining means 30. This may be accomplished by securing attachment cords or straps 42 by use of a slipknot or releasable attachment of cords 42 to doughnut-shaped restraining means 30, for instance, a Velcro TM -type reusable adhesive. Alternately, straps 42 may be secured or sized to break at a predetermined tension thereby releasing restraining means 30 from attachment to saddle 10. A preferred embodiment of a releasable doughnut-shaped restraining means 60 is shown in FIG. 2. Releasable doughnut-shaped restraining means 60 includes first and second semicircular or semi-elliptical hemi-doughnut shaped restraining means 62 and 64, respectively, which releasably fit together to make a releasable circular doughnut-shaped restraining means by means of attachment means 66 which may be any suitable releasable attachment, such as releasable glue, pressure-fit snap arrangement, or, preferably, a Velcro TM -type attachment. For some applications, a single releasable attachment means 66 may be used for doughnut-shaped releasable restraining means 60, such as in the front or back area as shown generally by separations 68. The single releasable attachment means 66 may also enhance initial envelopment of the rider by ease of placing restraining means 60 around the rider. For other applications, all four areas may incorporate a releasable attachment means 66.

In conclusion, a new type of releasable restraining means has been disclosed suitable for use with saddle-type seats for horses, motor vehicles, or other forms of locomotion. The releasable restraining means of the invention is in the form of a toroidal, semicircular, or elliptical doughnut-shaped rubber bladder or other suitable material for circumventing the rider and securing his lower extremities to the saddle, thereby allowing his upper torso to be free to manipulate the vehicle or the reins of a horse.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A releasable restraint means for securing a rider's lower torso to a saddle, thereby allowing his upper torso free movement, comprising:

(a) a toroidal, doughnut-shaped restraining means for circumventing the rider wherein the doughnut-shaped restraining means is made of a flexible bladder material, said bladder chosen from the group consisting of rubber, plastic, and vinyl; and (b) attachment means for securing the restraining means to the saddle, further comprising:

(i) multiple "D" rings attached to the restraining means;

(ii) multiple straps threaded through the "D" rings thereby securing the restraining means tot he saddle.

2. A releasable restraint means for securing a rider to a saddle including:

(a) first and second annular, hemi-doughnut-shaped restraining means for releasable attachment to each other to form a releasable, circular, doughnut-shaped restraining means, made from a suitable material chosen form the group consisting of rubber, plastic, and vinyl;

(b) attachment means for securing the restraining means to the saddle, further comprising:

(i) multiple "D" rings attached to the restraining means;

(ii) multiple straps having Velcro TM fasteners threaded through the "D" rings thereby securing the restraining means to the saddle.

* * * * *